US006974540B1

(12) United States Patent
Fleischmann

(10) Patent No.: US 6,974,540 B1
(45) Date of Patent: Dec. 13, 2005

(54) STREET CURB DRAIN FILTER

(76) Inventor: Charles R. Fleischmann, 2801 Abbeydale Ct., Brentwood, CA (US) 95413

( * ) Notice: Subject to any disclaimer, the term of this patent is extended or adjusted under 35 U.S.C. 154(b) by 0 days.

(21) Appl. No.: 10/974,641

(22) Filed: Oct. 27, 2004

(51) Int. Cl.[7] ..... B01D 35/02; E03F 5/14

(52) U.S. Cl. ..... 210/163; 210/164; 210/248; 404/4

(58) Field of Search ..... 210/163, 164, 210/248, 499; 404/2, 3, 4, 5

(56) References Cited

U.S. PATENT DOCUMENTS 232,948 A * 10/1880 Dernham ..... 210/318
248,559 A * 10/1881 Jackson ..... 4/220
295,823 A * 3/1884 Sievering ..... 404/4
714,185 A * 11/1902 Jackson et al. ..... 404/4
791,381 A * 5/1905 Thompson ..... 210/532.1
809,201 A * 1/1906 Lutz ..... 210/314
1,133,836 A * 3/1915 Bolger ..... 47/66.1
1,220,123 A * 3/1917 Heybach ..... 210/136
1,293,785 A * 2/1919 Hurst ..... 47/68
1,433,043 A * 10/1922 Shrauger ..... 47/79
1,654,247 A * 12/1927 Egan ..... 210/164
1,659,307 A * 2/1928 Wittman ..... 210/163
2,263,259 A * 11/1941 Boosey ..... 210/314
2,615,526 A * 10/1952 Lane ..... 210/164
2,701,027 A * 2/1955 Scoville ..... 210/163
D211,957 S * 8/1968 Penniman ..... D11/156
D228,779 S * 10/1973 Kleine ..... D11/156
D265,893 S * 8/1982 Whiting ..... D11/156
4,594,157 A * 6/1986 McGowan ..... 210/163
4,610,566 A * 9/1986 Albang et al. ..... 404/4
D307,877 S * 5/1990 White, Jr. ..... D11/148
D316,058 S * 4/1991 Mitchell et al. ..... D11/156
5,069,781 A * 12/1991 Wilkes ..... 210/164
5,232,587 A * 8/1993 Hegemier et al. ..... 210/162
5,345,741 A * 9/1994 Slater et al. ..... 52/646
5,372,714 A * 12/1994 Logue, Jr. ..... 210/164
5,403,474 A * 4/1995 Emery ..... 210/163
5,405,539 A * 4/1995 Schneider ..... 210/747
5,480,254 A * 1/1996 Autry et al. ..... 404/2
5,575,925 A * 11/1996 Logue, Jr. ..... 210/747
D403,268 S * 12/1998 Dignam ..... D11/156
5,849,181 A * 12/1998 Monteith ..... 210/163
5,849,198 A * 12/1998 Sharpless ..... 210/693
6,062,767 A * 5/2000 Kizhnerman et al. ..... 405/39
6,080,307 A * 6/2000 Morris et al. ..... 210/163
6,106,706 A * 8/2000 Roy et al. ..... 210/99
6,106,707 A * 8/2000 Morris et al. ..... 210/163
6,149,803 A * 11/2000 DiLoreto et al. ..... 210/164
6,217,756 B1 * 4/2001 Martinez ..... 210/163
6,254,770 B1 * 7/2001 Remon ..... 210/163
6,261,444 B1 * 7/2001 Forse ..... 210/163

(Continued)

*Primary Examiner*—Robert James Popovics
(74) *Attorney, Agent, or Firm*—Jack Lo

(57) ABSTRACT

A street curb drain filter is comprised of U-shaped brackets for attaching to an inside wall of a street curb drain adjacent an inlet. A horizontal retaining bar is attached to the outer ends of the brackets. The lower edge of a horizontally elongated flexible net is attached to the retaining bar. The upper edge of the net is connected to the interior ceiling of the drain with eye bolts and S-hooks. A horizontally elongated debris basin is supported within the brackets. A filter media pack is positioned inside the basin adjacent a perforated outer wall of the basin. Water flowing from the street into the drain is directed through the filter. When runoff is relatively light, debris flowing into the drain is collected inside the basin. When runoff is relatively heavy or when the basin is clogged, debris bypassing the basin is filtered by the net.

3 Claims, 2 Drawing Sheets

U.S. PATENT DOCUMENTS 6,294,095 B1 * 9/2001 Lewis ..... 210/747
6,306,293 B1 * 10/2001 Schilling et al. ..... 210/164
6,368,499 B1 * 4/2002 Sharpless ..... 210/164
D463,123 S * 9/2002 Hradisky ..... D3/306
6,517,709 B1 * 2/2003 Cardwell et al. ..... 210/164
6,531,059 B1 * 3/2003 Morris et al. ..... 210/164
6,551,023 B2 * 4/2003 Allard ..... 405/36
6,562,233 B1 * 5/2003 Schilling et al. ..... 210/164
6,666,974 B2 * 12/2003 Page ..... 210/747
6,726,402 B1 * 4/2004 Martinez ..... 405/40
6,797,162 B2 * 9/2004 Happel ..... 210/163
6,805,804 B2 * 10/2004 Page ..... 210/747
6,869,523 B2 * 3/2005 Martinez ..... 210/121
6,872,029 B2 * 3/2005 Allard et al. ..... 405/36
6,884,343 B2 * 4/2005 Harris et al. ..... 210/163
2002/0113025 A1 * 8/2002 Gauldin et al. ..... 210/767
2003/0047497 A1 * 3/2003 Harris et al. ..... 210/163
2003/0098267 A1 * 5/2003 Page ..... 210/164
2003/0127380 A1 * 7/2003 Morris et al. ..... 210/164
2003/0132150 A1 * 7/2003 Happel ..... 210/163
2003/0173277 A1 * 9/2003 Shaw et al. ..... 210/163
2004/0226869 A1 * 11/2004 McClure et al. ..... 210/163
2005/0051499 A1 * 3/2005 Nino ..... 210/747
2005/0067338 A1 * 3/2005 Page ..... 210/164

* cited by examiner

STREET CURB DRAIN FILTER

BACKGROUND OF THE INVENTION

1. Field of the Invention

The invention broadly relates to street curb drain filters.

2. Prior Art

Water flowing into a street curb drain carries debris and liquid pollutants into the drain and out to sea. The debris may clog the drain, and pollutants are harmful to the environment. Debris and pollutants in runoff water are relatively heavy at construction sites, so sandbags are typically piled around a curb drain inlet as a filter. However, although sandbags block large debris, they impede water flow and do not effectively filter liquid pollutants.

BRIEF SUMMARY OF THE INVENTION

A street curb drain filter is comprised of U-shaped brackets for attaching to an inside wall of a street curb drain adjacent an inlet. A horizontal retaining bar is attached to the outer ends of the brackets. The lower edge of a horizontally elongated flexible net is attached to the retaining bar. The upper edge of the net is connected to the interior ceiling of the drain with eye bolts and S-hooks. A horizontally elongated debris basin is supported within the brackets. A filter media pack is positioned inside the basin adjacent a perforated outer wall of the basin. Water flowing from the street into the drain is directed through the filter. When runoff is relatively light, debris flowing into the drain is collected inside the basin. When runoff is relatively heavy or when the basin is clogged, debris bypassing the basin is filtered by the net.

DRAWING REFERENCE NUMERALS

10. Drain Filter
11. Bracket
12. Retaining Bar
13. Flexible Net
14. Eye Bolt
15. S-Hook
16. Cutout
17. Debris Basin
18. Media Pack
19. Outer Wall
20. Curb Drain
21. Inside Wall
22. Inlet
23. Ceiling
24. Flow Path
25. Flow Path

DETAILED DESCRIPTION OF THE INVENTION

FIG. 1

Figure 1:
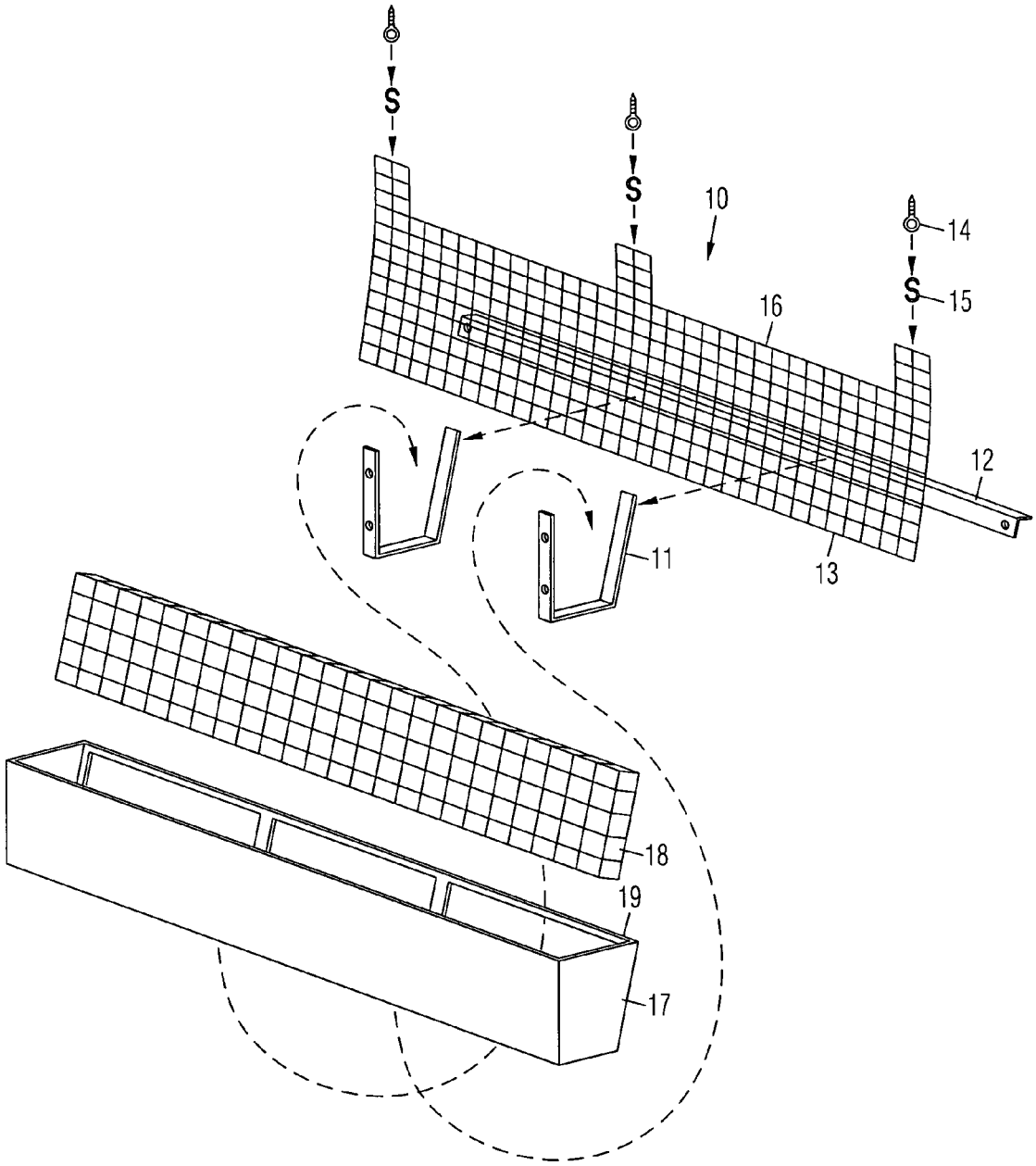
FIG. 1 is an exploded view of a street curb drain filter.

A preferred embodiment of a street curb drain filter 10 is shown in FIG. 1. Filter 10 is comprised of U-shaped brackets 11 for attaching to an inside front wall of a street curb drain. A horizontal retaining bar 12 is for attaching to the outer ends of brackets 11. The lower edge of a horizontally elongated flexible net 13 is attached to retaining bar. The upper edge of net 13 is for connecting to the interior ceiling of the drain with eye bolts 14 and S-hooks 15. Cutouts 16 are provided along the upper edge of net 13, although the upper edge of net 13 may be completely straight instead. A horizontally elongated debris basin 17 is for being supported within brackets 11. A filter media pack 18 is for positioning inside basin 17 adjacent a perforated outer wall 19 of basin 17.

FIG. 2

Figure 2:
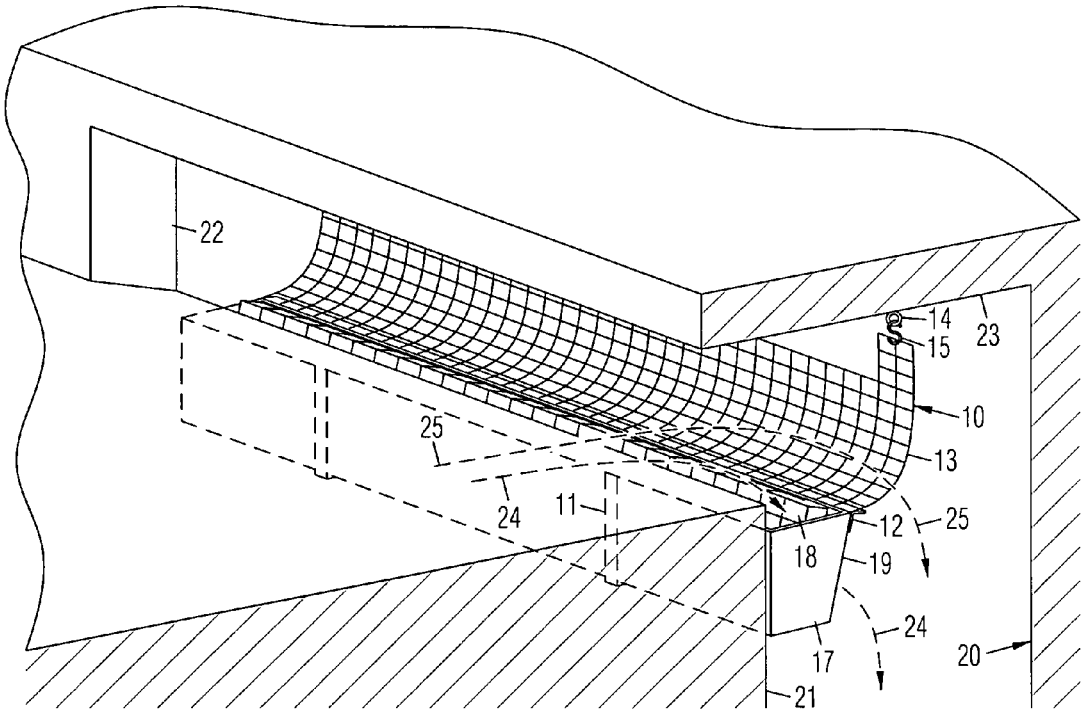
FIG. 2 is a perspective view thereof installed in a street curb drain.

Drain filter 10 is shown in FIG. 2 installed in a street curb drain 20. Brackets 11 are attached to an inside wall 21 of drain 20 adjacent an inlet 22. Retaining bar 12 is attached to the outer ends of brackets 11 and positioned adjacent an outer rim of basin 17. The lower edge of net 13 is attached to retaining bar 12. Eye bolts 14 are attached to an interior ceiling 23 of drain 20. The upper edge of net 13 is connected to eye bolts 14 with S-hooks 15 at a 40 to 60 degree angle relative to ceiling 23. Debris basin 17 is supported within brackets 11. Filter media pack 18 is positioned inside basin 17 adjacent perforated outer wall 19 of basin 17.

Water flowing from a street gutter into drain 20 must go through filter 10. When runoff is relatively light, debris flowing into drain along a flow path 24 is collected inside basin 17. When runoff is relatively heavy or when basin 17 is clogged with debris, relatively large debris flowing along a flow path 25 bypassing basin 17 is filtered by net 13.

Although the foregoing description is specific, it should not be considered as a limitation on the scope of the invention, but only as an example of the preferred embodiment. Many variations are possible within the teachings of the invention. For example, different attachment methods, fasteners, materials, dimensions, etc. can be used unless specifically indicated otherwise. The relative positions of the elements can vary, and the shapes of the elements can vary. Therefore, the scope of the invention should be determined by the appended claims and their legal equivalents, not by the examples given.

I claim:

1. In a street curb drain, the improvement comprising:

a filter, wherein said filter includes:

U-shaped brackets attached to an inside front wall of a street curb drain;

a horizontal retaining bar attached to outer ends of the brackets;

a horizontally elongated flexible net with a lower edge attached to the retaining bar and an upper edge connected to an interior ceiling of the drain; and a horizontally elongated debris basin supported within the brackets.

2. The street curb drain filter of claim 1, further including a cutout along the upper edge of the net for drainage when the net is clogged.

3. The street curb drain filter of claim 1, further including a filter media pack inside the basin adjacent a perforated outer wall of the basin.

* * * * *